US006174474B1

(12) United States Patent
Stein et al.

(10) Patent No.: US 6,174,474 B1
(45) Date of Patent: Jan. 16, 2001

(54) DEVICE AND METHOD FOR PRODUCING MICROFILAMENT YARNS WITH HIGH TITER UNIFORMITY FROM THERMOPLASTIC POLYMERS

(75) Inventors: Manfred Stein, Domat/Ems; Christian Baumann, Tamins; Ulrich Kemp, Domat/Ems; Gunter Goossens, Trin, all of (CH)

(73) Assignee: EMS-Inventa AG, Zürich (CH)

( * ) Notice: Under 35 U.S.C. 154(b), the term of this patent shall be extended for 0 days.

(21) Appl. No.: 09/309,591

(22) Filed: May 11, 1999

(30) Foreign Application Priority Data

May 14, 1998 (DE) ..... 198 21 778

(51) Int. Cl.[7] ..... D01D 5/092; D01D 5/096

(52) U.S. Cl. ..... 264/129; 264/130; 264/211.12; 264/211.14; 425/72.2; 425/377; 425/378.1; 425/378.2; 425/379.1; 425/382.2; 425/464

(58) Field of Search ..... 264/129, 130, 264/211.12, 211.14; 425/72.2, 377, 378.1, 378.2, 379.1, 382.2, 464

(56) References Cited

U.S. PATENT DOCUMENTS 3,969,462 7/1976 Stofan .
5,935,512 * 8/1999 Haynes et al. ..... 264/211.14 X

FOREIGN PATENT DOCUMENTS

3629731A1 3/1987 (DE) .
3822571A1 2/1990 (DE) .
3708168 C2 6/1992 (DE) .
19544662 A1 6/1997 (DE) .
19716394C1 9/1998 (DE) .
19653451 C2 11/1998 (DE) .
0646189B1 4/1995 (EP) .
9215732 9/1992 (WO) .

OTHER PUBLICATIONS

Tekaat et al., "Chemical Fibers/Textile Industry" pp. 877–880, (1992).

* cited by examiner

*Primary Examiner*—Leo B. Tentoni
(74) *Attorney, Agent, or Firm*—Browdy and Neimark

(57) ABSTRACT

A device and a method are disclosed, by means of which microfilament yarns made of synthetic polymers can be produced with increased uniformity of the titer, dye absorption and improved physical yarn properties at increased production speeds by means of a spinning process with spinnerets of high hole density and a central cooling unit.

34 Claims, 11 Drawing Sheets

DEVICE AND METHOD FOR PRODUCING MICROFILAMENT YARNS WITH HIGH TITER UNIFORMITY FROM THERMOPLASTIC POLYMERS

FIELD OF THE INVENTION

The present invention relates to a device and method for producing microfilament yarns with high titer uniformity (Uster value) from thermoplastic polymers, which are preferably intended for further processing as textiles.

BACKGROUND OF THE INVENTION

The production of filaments and filament yams generally takes place in accordance with the melt-spinning method.

Based on a molten flow, which is delivered from an extruder or directly from the poly-condensation installation, the polymer is distributed to the individual spinning spinnerets by spinning pumps. After the melt exits the capillary bores of the spinnerets in the form of fine filaments, these are cooled by means of a cooling medium, thereafter gathered or bundled, treated with spinning preparations and wound.

At the beginning of the development of melt spinning methods, the spun filaments were cooled without the active support of a device only by means of their own vertical movement in the air medium on their way to being wound.

Since the mid-fifties, active cooling systems have been employed, primarily with the use of cross-flow air diffusion, to reduce the height of the machines and to increase the capacity.

Cooling of the filaments is a very essential step in the total process of producing a polymer filament. Uniformity of mass, the quality of dye absorption, as well as the textile properties, such as strength and stretching, are affected by this.

The past ten years have seen a development in spinning technology for producing filament yarns with still finer titers of individual filaments, so-called microfilaments, of a linear density below 1 dtex per filament.

The filament yarns which are customarily used for further textile production, having a total titer of 84 dtex, or respectively 167 dtex, are then no longer composed of 36, or respectively 72 filaments, but in accordance with the present state of the art of approximately 100 to 200 individual filaments.

Products made of so many microfilaments are distinguished by special properties, which are to the advantage of the consumer.

For cooling filaments or threads after melt spinning, customarily a so-called cross-flow air diffuser method is used in accordance with the state of the art. However, this makes it necessary to employ spinnerets of large diameter for yarns with high filament counts, since, for reasons of uniformity of the product, with filament cooling by means of these methods it is not possible to exceed hole densities of approximately 8 holes/cm$^2$ on the spinneret.

However, large spinnerets result in disadvantages in regard to space requirements of the production installations and in regard to product quality because of the increasingly non-uniform temperature over the surface of the spinneret, as well as the increased dwell time of the polymer melt in the nozzle package.

Devices which have been shown to be particularly suited to spinning multi-capillary products are known, for example, from DE 36 29 731 A1, DE 196 53 451 C1 or WO 92/15732 A1.

In these devices the filaments are cooled by means of a central air diffuser system after exiting the spinneret. To this end the filaments are spun from a spinneret, whose capillary bores or holes are arranged in one or several, preferably concentric, circles. The diameter of the smallest circle must be sufficiently large in order to be able to install the cooling device, the so-called air flow candle, centered underneath the spinning device. To this air flow candle, consisting of a tube-shaped, porous gas-permeable hollow body, air is supplied from one tube end, the oppositely located tube end is closed. The cooling air flows radially outward through the porous candle and in this way cools the filaments, which are arranged concentrically around it. After passage through the air diffusion zone, the filaments graze a ring for the application of the spinning preparation. Thereafter they are combined into a strand underneath the air flow candle. The filaments spun in this way are suitable for producing staple fibers.

A central air diffusion process for producing technical yarns, which are distinguished by low shrinkage and a high modulus, from a large number of individual filaments with large capillary titers of more than 1 dtex/fil is claimed in DE 196 53 451 C1.

The production of technical polyester yarn with a low titer while using a central cooling unit, which starts with a zone of a length of approximately 15 to 60 cm, through which no air is diffused, but which is heated from the outside in order to improve the Uster uniformity of the yarn, is described in U.S. Pat. No. 3,969,462.

A central air diffusing device with an annular die slot screen, which is arranged between the spinneret and the air flow candle for preventing interference with spinning, is described in DE 38 22 571 A1. It is pointed out that in actual use, without such an arrangement there are frequent interruptions of the operation because of filament breaks, and the mass uniformity of the filaments remains unsatisfactory in comparison with cross-flow air diffusion.

Although the devices known from the prior art have proven themselves for producing products at a high rate of throughput, such as are necessary for the production of staple fibers and of yarns for technical applications, they are insufficient for the production of microfilament endless yarns, wherein the throughput per nozzle is considerably less. Clear disadvantages occur in connection with the production of microfilament yarns, which will be described in greater detail below:

The spinning of microfilaments for textile yarns is in no way a trivial undertaking for one skilled in the art. As known from the prior art, in connection with such products the danger arises that the spinneret cools because of the low melt throughput and spinning problems occur increasingly because of this, such as described by Th. Tekaat in "Chemiefasern/Textilindustrie" [Chemical Fibers/Textile Industry], 42/194, p. 879.

Therefore the known devices were only employed for large titers clearly above 1 dtex/fil, or in fiber spinning methods with a very high hole count per spinneret. In DE 37 08 168 C2, for example, more than 700 holes per spinneret are mentioned. In fiber spinning methods the spinneret is provided with sufficient heat by the molten mass because of the required high melt throughput.

In order to overcome the cooling of the spinneret during the production of microfilaments, one skilled in the art then makes use of higher spinning, or respectively melt temperatures, in particular in the case of cross-flow air diffusion. However, higher temperatures adversely affect the dependability of the process to a considerable degree, or respectively the frequency of interruptions is increased because of the increased thermal decomposition of the polymer melt in the melt supply system, the so called "spin beam" and nozzle package, and of the increasing contamination on the surface of the spinneret.

A device for the passive cooling of spun filaments is described in the unpublished DE patent document DE 197 16 394.7-26, by means of which it is only possible to achieve hole counts of maximally 300 for spinnerets of customary size with diameters of up to 110 mm and only hole densities around 10 holes/cm$^2$ A hole density of only maximally 25 holes/cm5 is achieved for spinnerets with a circular-shaped arrangement of holes in EP 0 646 198 B1.

Accordingly, the upper limit of the hole density known from the prior art remains below 30 holes/cm$^2$. Higher hole densities can also not be achieved with this device without losses in quality and an increase of spinning problems.

The devices and methods described in the prior art cannot achieve this goal.

OBJECT AND SUMMARY OF THE INVENTION

The present invention is therefore based on the object of designing in particular the method step of cooling in connection with the spinning of microfilaments from thermoplastic polymers with an individual capillary titer of less than I dtex/filament with the aid of a suitable device in such a way, that the number of spinning interferences is reduced and microfilament yarns with improved textile-mechanical properties and more uniform dye absorption result, wherein the equipment and production costs should be reduced, if possible.

According to the present invention, a device is provided for producing microfilament yarn from thermoplastic polymers with a maximum of 500 dtex total titer and with individual filament titers of a maximum of 1 dtex, preferably a maximum of 0.8 dtex, and high titer uniformity. This device consists of

- a spinneret with capillary holes in a ring-shaped arrangement and a hole density L/A of up to 40 holes/cm$^2$ of effective outlet surface;
- an air-permeable active cooling unit for tempered air, which can be centrally located at the distance S under the spinneret and fixed in place;
- an insertion device with integrated air supply devices for the cooling unit;
- at least one yarn guide element from the group of yarn guides or guide panels;
- at least one preparation application device;
- a yarn monitor, which iso optionally combined with a control of the insertion device; and
- at least one winding unit.

The filaments spun together from the spinneret are conducted, individually or divided into more than one separate filament bundle, provided with suitable preparation, and wound. The distance S a function of the equation:

$$S = \frac{1.4 \times \exp(2.01 \times TEK)}{\sqrt[4]{RL}} - 1[\text{mm}];$$

wherein S is the distance between the spinneret and cooling unit in mm;

TEK is the titer of individual capillaries in dtex;

RL is the number of rows of holes located behind each other on the spinneret to a maximum of 35 mm, and wherein the effective cooling length Lk of the cooling unit can be set as a function of the titer and the spinning speed.

According to the present invention, microfilament yarns are produced from thermoplastic polymers of a maximum of 500 dtex total titer and with individual titers of the filaments of a maximum of 1 dtex, preferably 0.8 dtex, and with great titer uniformity. This process comprises the steps of:

- melt spinning the filaments with a total titer between 22 and 500 dtex at a spinning speed between 2000 and 7000 m/min;
- cooling the filaments with tempered air by means of a cooling unit with an effective cooling length Lk at a distance S from the spinneret;
- dividing the filaments in separate guide elements into one or several filament bundles;
- applying a preparation to the filament bundles;
- winding the separate filament bundles at a speed between 2000 and 7000 m/min, wherein the distance S is a function of the equation:

$$S = \frac{1.4 \times \exp(2.01 \times TEK)}{\sqrt[4]{RL}} - 1[\text{mm}];$$

wherein S is the distance between the spinneret and cooling unit in mm;

TEK is the titer of individual capillaries in dtex;

RL is the number of rows of holes located behind each other on the spinneret to a maximum of 35 mm, and wherein in comparison with the melt temperature the surface of the spinneret can experience homogeneous cooling up to 10° C. over the entire spinneret, and wherein the solidification point of the bundles of filaments is set as a function of the titer and spinning speed to 1 to 40 mm above the end of the effective cooling length Lk of the cooling unit.

Microfilaments produced by the method and apparatus of the present invention have Uster values U below 1.2% and U½ below 0.8%.

It has now been surprisingly shown that it is possible to achieve very high hole densities in the device in accordance with the invention, which contains a suitable active central cooling unit, for the production of microfilament yarns up to a maximum of 500 dtex, preferably up to 250 dtex, with an individual capillary titer of less than 1 dtex/filament, preferably below 0.8 dtex/filament. It was furthermore unexpectedly shown that such high hole densities can be most dependably achieved if the filaments are cooled directly following their exit from the spinneret.

Therefore the annular die slot screen described in DE 38 22 571 A1 has been shown to be insufficient for the production of microfilaments. It is also insufficient to cool the filaments only in a narrow, slot-shaped segment in the vicinity of the nozzle, as claimed in DE 195 44 662 A1.

To attain the desired object it was necessary to develop the cooling function of the central cooling unit, and its positioning and its shape had to be newly developed.

It is also important for the function of the device in accordance with the invention, that the solidification of the filaments takes place prior to the first contact with the yarn guide elements of the device, and that the distribution of the air diffusion speed is as constant as possible over the cross section.

Moreover, as homogeneous as possible a temperature profile over the spinneret must be assured, i.e. it is necessary to take steps which prevent an inhomogeneous cooling of the spinneret. The device in accordance with the invention with the integrated cooling unit assures a very uniform cooling of the filaments for spinnerets with especially high hole counts in comparison with cross-flow air diffusion.

Since the totality of the filaments enclose the so-called air flow candle in the manner of a tube-shaped envelope, the radially introduced cooling air tends to widen this envelope in a double cone manner for escaping. This widening of the filament envelope additionally stabilizes the positions of the individual filaments as if they were on an air cushion, and prevents a mutual contact because of the increasing lateral distance between the individual filaments. Because of this it is possible to clearly reduce the lateral distance between two capillary bores in the spinneret in comparison with the prior art.

This in turn makes possible more capillary bores or nozzle openings per circle of holes, because of which the number of hole rows can be quite clearly reduced in comparison with cross-flow air diffusion. A reduced number of rows of holes through which air flows results in reduced production differences.

Thus, in contrast with cross-flow air diffusion, with the device in accordance with the invention there are only very small mass differences between the individual filaments as a result of more even cooling. These very small differences in turn are decisive for the good CV values of the physical textile properties.

The device in accordance with the invention attains the desired object in particular in that a spinneret which, with a diameter, customary in accordance with the prior art, of up to 110 mm and up to 600 capillary bores, has a very high hole density of up to 40 holes per $cm^2$ of effective outlet surface (of the rows of holes), is combined with an active cooling unit, which initiates cooling of the exiting filaments directly under the nozzle at a distance S and continues it on an air cushion, which is formed by an air flow emerging at a uniform speed over the entire effectively cooled length, until solidification and preparation.

If this does not take place, the filaments begin to oscillate in an uncontrolled manner, which decisively reduces the Uster value for uniformity. The following FIGS. 1 to 13 are used to explain the exemplary embodiments of the invention, which have partially been represented in longitudinal and cross section.

BRIEF DESCRIPTION OF THE DRAWINGS

FIG. 11 represents a spinning installation with cooling units pivoted in.

DETAILED DESCRIPTION OF THE PREFERRED EMBODIMENTS

Figure 1A:
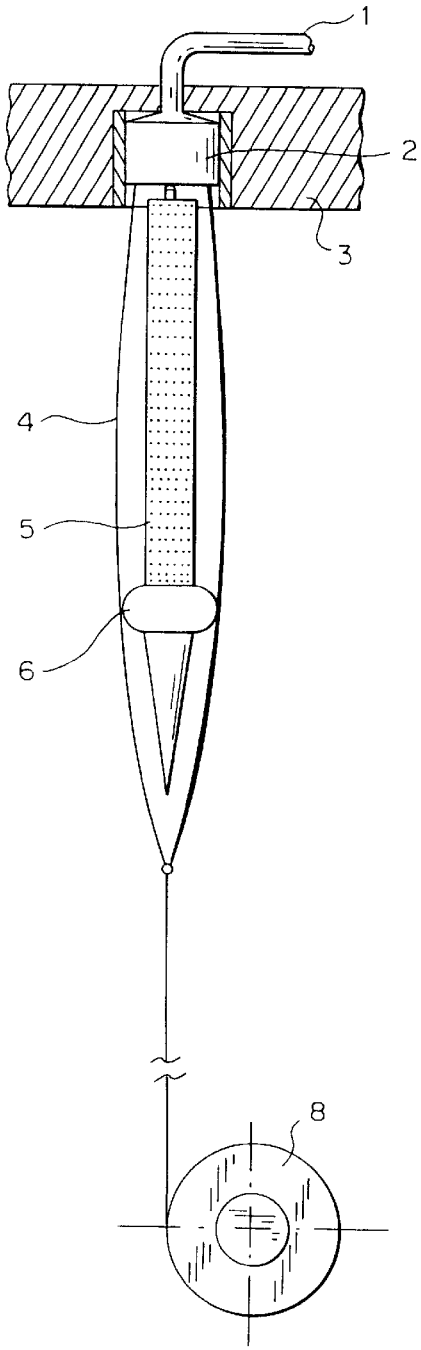
FIGS. 1*a, b* represent a schematic overview of the device and the method.
Figure 1B:
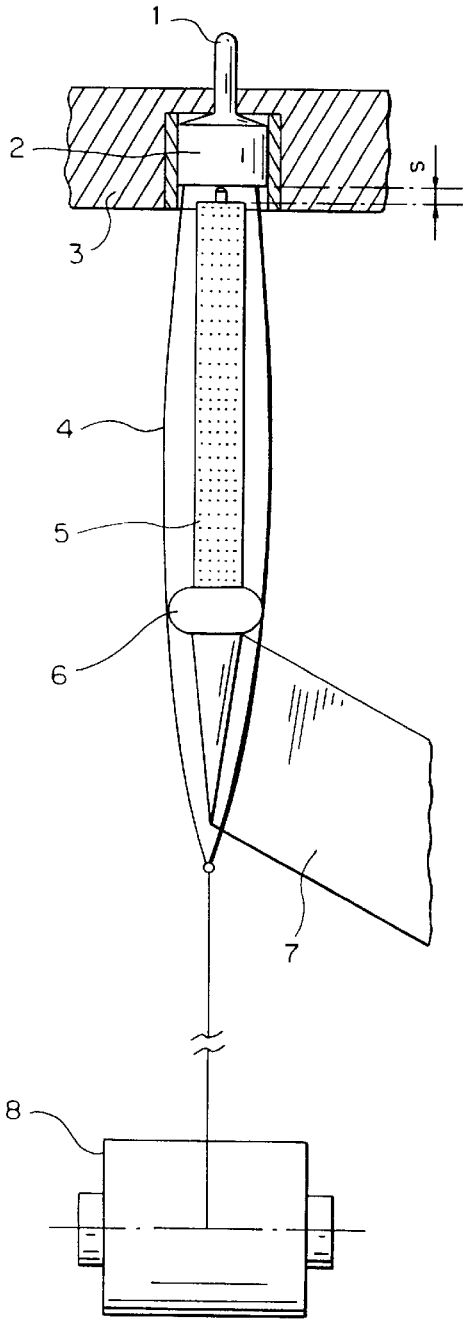

The device in accordance with the invention is schematically represented in FIGS. 1*a* and 1*b,* having: a melt line 1 for supplying the polymer melt to the spinneret 2 in the spin-die manifold 3, the filaments 4 exiting the capillary bores of the spinneret 2, which are conducted for solidification along the cooling unit 5, which (in the inserted state) is located at the distance S centered under the spinneret 2, wherein Lk is the effective cooling length of the cooling unit 5, the positioning filament guide 6, the arm of the insertion devices 7 with (not visible) integrated air supply lines, and the winding unit 8.

The cooling unit 5 is centrally fixed symmetrically in respect to the die by means of a centering pin at the distance S of maximally 35 mm under the spinneret 2. This distance S can be variably adjusted as a function of the titer.

The space in the geometric extension of the plug diameter with the distance S is thermally insulated or provided with additional heating and cooling elements to avoid temperature differences over the entire cross section of the surface on the outlet side of the spinneret 2, and between the spinneret 2 and the cooling unit 5.

The insulation makes it possible not only to keep the temperature of the surface of the spinneret constant to the greatest extent, but simultaneously maintain it 5 to 10° C. below the temperature of the exiting melt.

Such an insulation preferably consists of a material with low thermal conductivity.

In a preferred embodiment the insulation is integrated into the spinneret 5.

In preferred embodiment variants, the ring- or circular-shaped arrangement of the capillary bores in the spinneret 2 is interrupted or divided into groups in order to make easier the separate combination of filaments 4 with the aid of separate filament guide elements into separate filament bundles, or for keeping the area above the insertion device 7 of the cooling unit 5 free of filaments 4.

The active cooling unit 5 consists of a hose-shaped air-permeable woven material (FIG. 8), which is widened in a double cone under the pressure of the exiting cooling air, or of a perforated tube element with an air feed on one side (FIG. 7), while the other end on the side of the spinneret is closed.

Figure 10B:
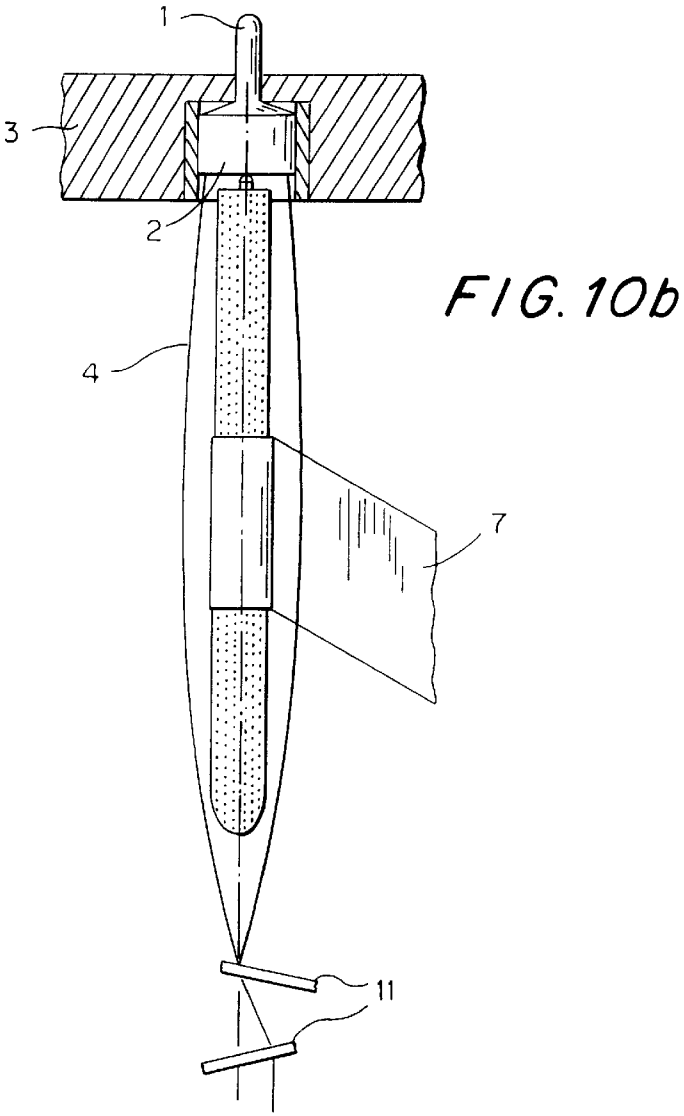
Figure 10A:
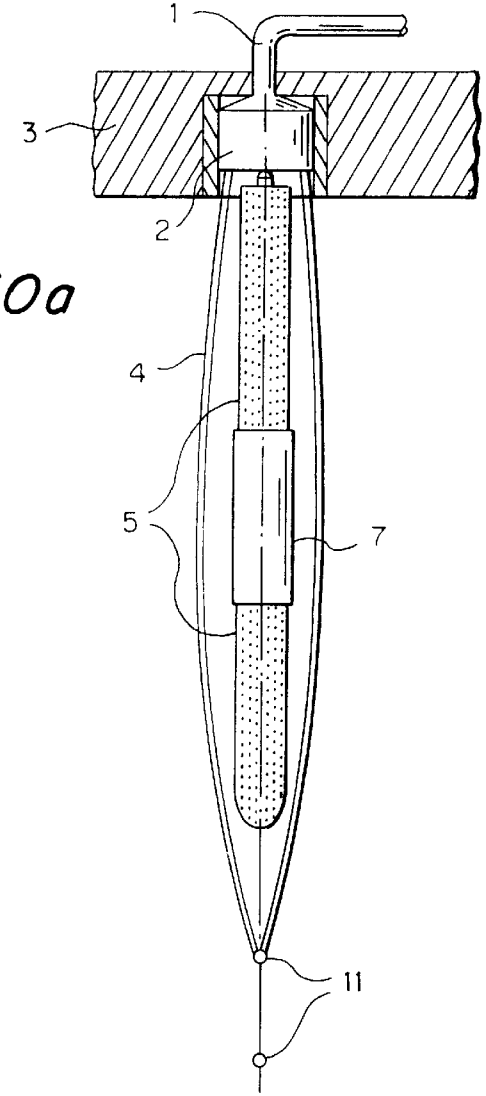

In other, preferred embodiments variants the cooling unit respectively consists of a tube element directed upward against the spinneret 2 from the direction of the insertion device, and a tube element directed downward in the path of the filaments (FIGS. 10*a, b*).

In a further special embodiment, the lower tube element is designed to come to a point in a cone shape toward the bottom. The length as well as the diameter of the cooling unit 5 can be varied and in this way matched to spinning conditions, particularly to the spinning speed and the spinning titer of the filaments.

The preferred diameters lie in the range between 10 mm and 106 mm and in a particularly advantageous manner are 1 to 40 mm smaller than the inner circle of the ring-shaped capillary bores in the spinneret 2. The length, in particular the effective cooling length Lk can be set by means of the length of the perforated portion, and selectively by means of additional non-perforated or differently perforated intermediate rings. It preferably lies in the range between 50 mm and 1000 mm.

Figure 9B:
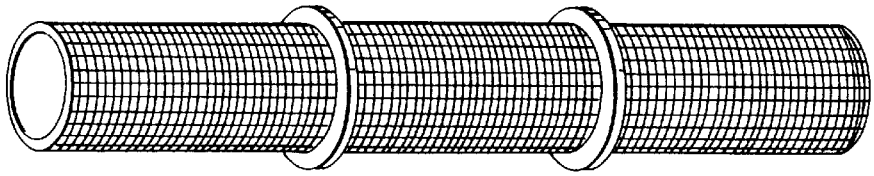
FIG. 9*b* shows a pluggable form of a cooling unit, FIGS. 10*a, b* show a cooling unit with an upper and a lower tube element.
Figure 9A:
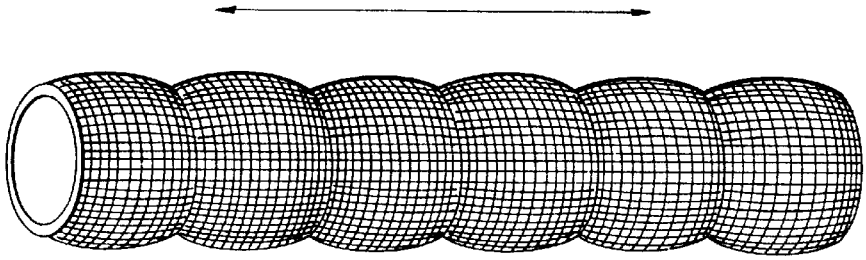
FIG. 9*a* shows a bellows as a cooling unit.

In special variations, the cooling unit 5 is embodied as a bellows or is pluggable for changing Lk (FIGS. 9*a, b*).

In further embodiments, the perforation of the cooling unit 5 is implemented by the size and shape of the hole, the distance between holes, the depth of the hole, or respectively the wall thickness of the unit and its orientation, as well as by the different embodiment of these parameters over the length of the unit for regulating the blown-in air, which can be tempered in the range between 15 and 200° C., or preferably of 18 to 10° C. below the $T_G$ of the spun polymer, and whose exit speed can also be controlled.

In special variants of the device, the blown-in air is only tempered prior to its exit from the cooling unit 5. This can take place uniformly or in different areas at different temperatures.

In further embodiment variants, displacement bodies have been installed in the interior of the cooling unit 5 for regulating the speed of the blown-in air, advantageously between 0.05 and 0.7 m/s, or devices for using the blown-in air in partial areas of the cooling unit 5 at different temperatures.

The cooling unit 5 can be positioned by the arm of an insertion device 7 under the spinneret 2 horizontally and vertically, or in a preferred manner on a vertical circular pivot track 13, or respectively can be completely pivoted out of the filament path.

Pivoting in and out can be controlled mechanically, pneumatically or electronically and is preferably combined with a filament monitor.

In particularly advantageous device variants, pivoting out of the cooling unit takes place by its own weight or by a spring force. The arm of the insertion device 7, into which the air supply line for the cooling unit 5 has also been integrated, preferably has a narrow, preferably a rectangular or oval cross section.

Figure 2A:
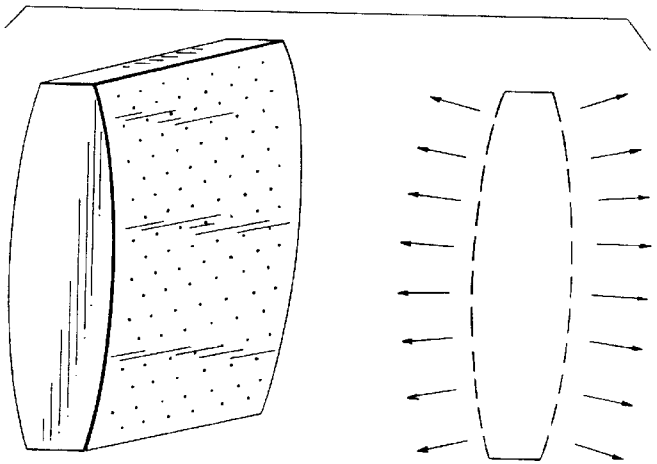
FIG. 2*a* represents the perforated structure of an insertion device.
Figure 2B:
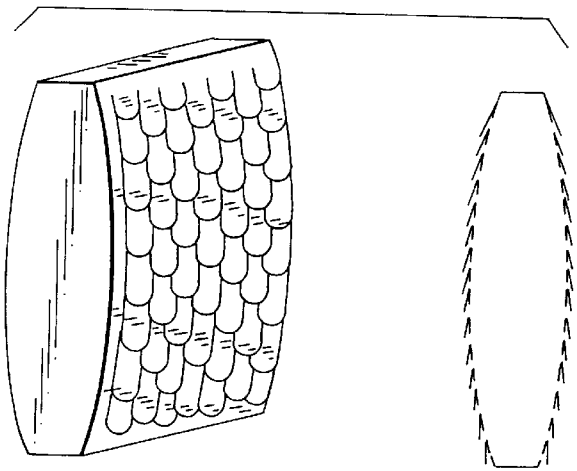
FIG. 2*b* shows a scale-like structure of an insertion device.

In a particular embodiment its surface is designed with friction-reducing diagonal structures or stampings in the form of diamonds or scales (FIG. 2*b*), which create an air cushion from the air accompanying the filaments, which prevents to a large extent the direct contact of the filaments with the insertion device 7.

In a further embodiment, the arm is provided with air outlet openings in the shape of a circle (FIG. 2*a*) or of slits, which permit the creation of a filament-deflection air flow to protect the device against impacting and adhering filaments.

The openings are advantageously arranged evenly in a close grid or, for reasons of the conservation of air, only at the critical points, i.e. at locations at which a contact with the filaments 4 must be avoided.

Of course, embodiments consisting of a mixture of structures and perforations, as well as a mixture of different structure and perforation geometries, are also suitable, as well as those, wherein the holder of the cooling unit is also perforated.

Figure 3:
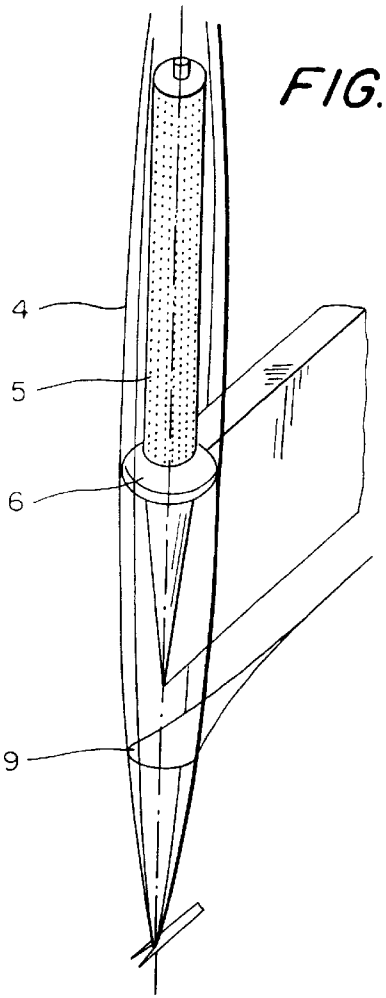
FIG. 3 represents a device with a drop-shaped filament guide.

In a further variation, the arm of the insertion device 7 is protected from contact with filaments by a specially shaped, for example drop-shaped, filament guide (9 in FIG. 3), at which the contact for all filaments is almost identical at the smallest possible, exactly defined surface.

The arrangement of a ring-shaped positioning filament guide 6 and 10 (FIG. 4) of a sufficiently large diameter is advantageous for preventing undesirable oscillating self-movements of the filaments 4 on the cooling path.

This filament guide is designed either as a dry filament guide or as an element for applying a preparation. The ring 10 of the dry filament guide, which touches the filament, consists of a wear-resistant material, for example ceramic aluminum oxide, or a similar surface coated with a resistant material on a metallic base.

Figure 5A:
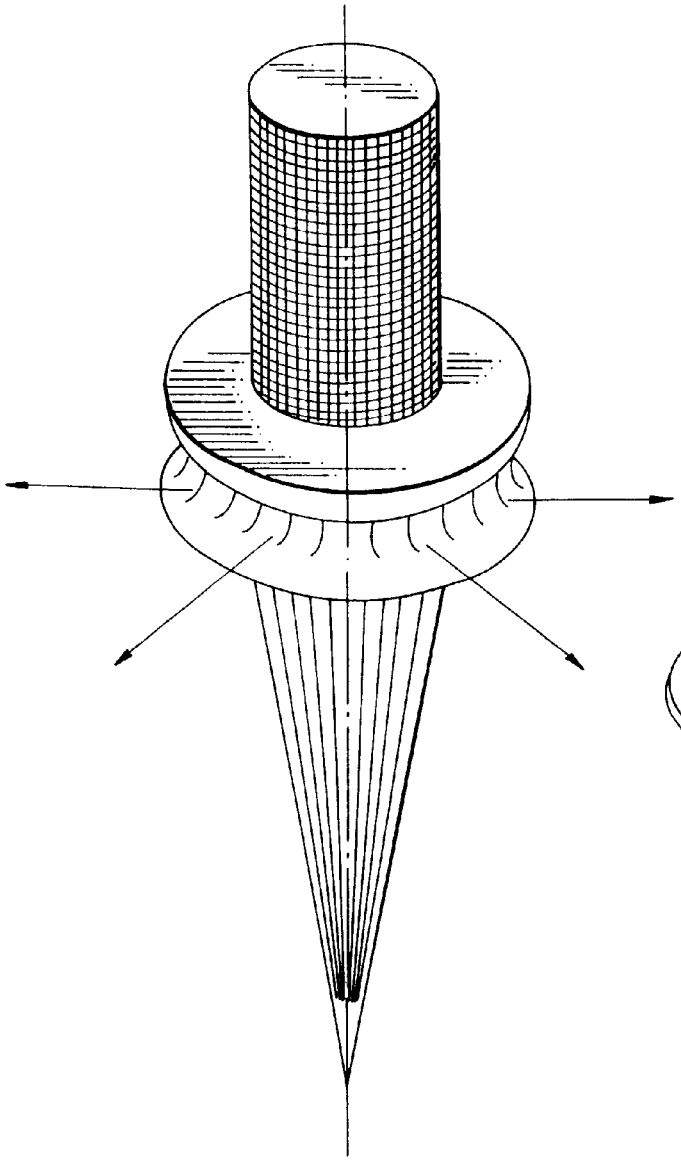

A further embodiment of the ring-shaped positioning filament guide 10 is represented in FIG. 5*a*. In this case a gas flow is conducted through a ring-shaped gap, because of which the individual filaments 4 flow on a gas cushion on the entire ring circumference, and a direct contact between the positioning filament guide 6 and the filaments 4 is prevented to the greatest extent possible.

Figure 5B:
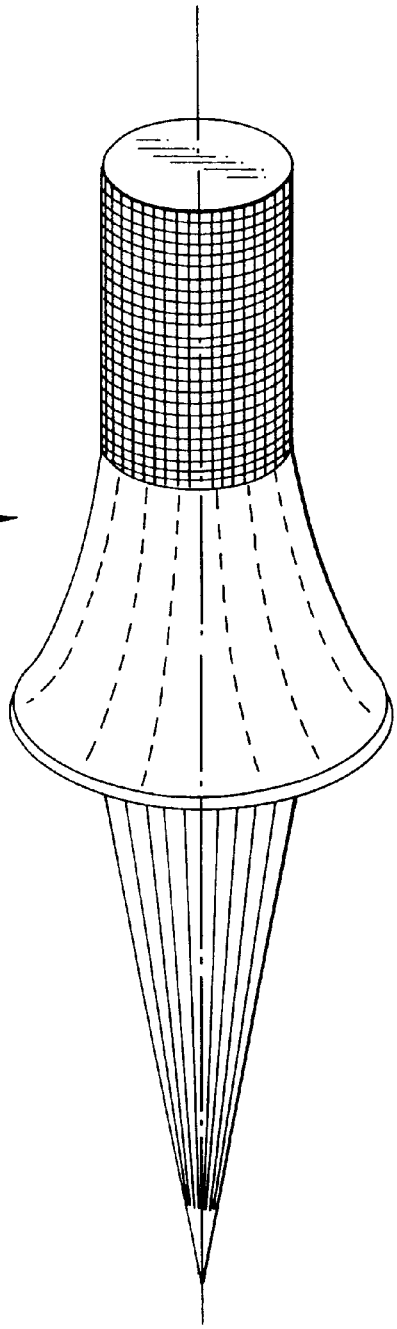

In an additional embodiment, the positioning filament guide 6 consists of a cone in accordance with FIG. 5*b*, which widens toward the bottom in a funnel or trumpet shape. The air carried along by the filaments 4 is accelerated on this cone and conducted against the filaments 4. An air cushion is formed by this deflected dragged air, so that the direct contact between the filaments 4 and the filament guide is prevented to the greatest extent possible.

The diameters of the filament guides are advantageously determined in accordance with Equation "I":

$$Dpf = \frac{exterior\ DL + interior\ DL}{2} - K[\text{mm}] \qquad \text{I}$$

Dpf=Diameter of the positioning filament guide in mm, DL=Diameter of the hole circle of the capillary bores in mm, Ddp=Diameter of the spinneret in mm $$-\frac{Ddp}{4.75} \le K \le \frac{Ddp}{4.75}$$

In the same way as the preparation device, they are advantageously height-adjustable and are embodied to be fixed in place at least 1 to 40 mm in front of the active end of the cooling unit 5.

In a further advantageous embodiment of the device, air stripping panels are arranged near the front of the preparation applicator, viewed in the direction of the filament travel, which assure an undisturbed and therefore uniform application of the preparation.

Figure 4B:
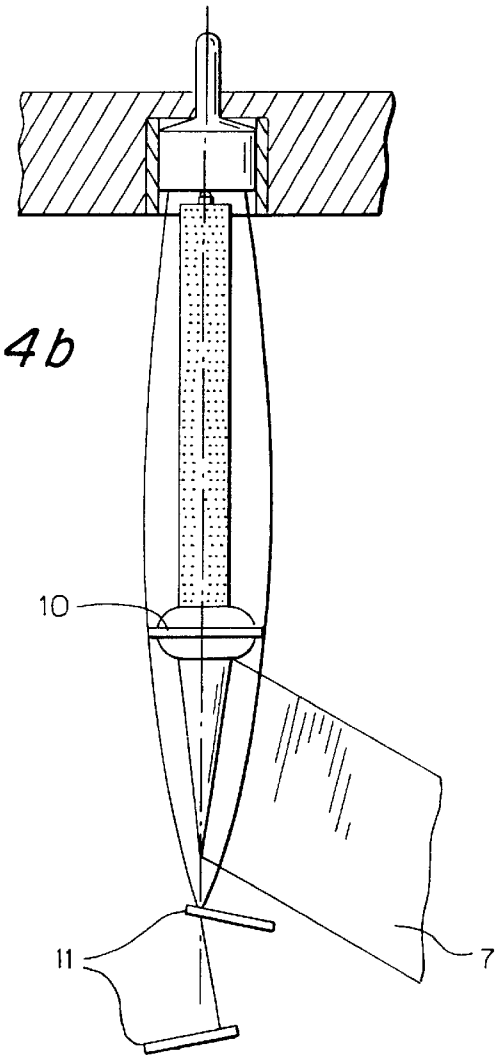
FIGS. 4*a, b,* show the application of a preparation by means of several preparation applicators, FIG. 5*a,* shows a position filament guide with a ring-shaped gap, FIG. 5*b,* shows a trumpet-shaped filament guide, FIGS. 6*a, b* show a device without a filament guide.
Figure 4A:
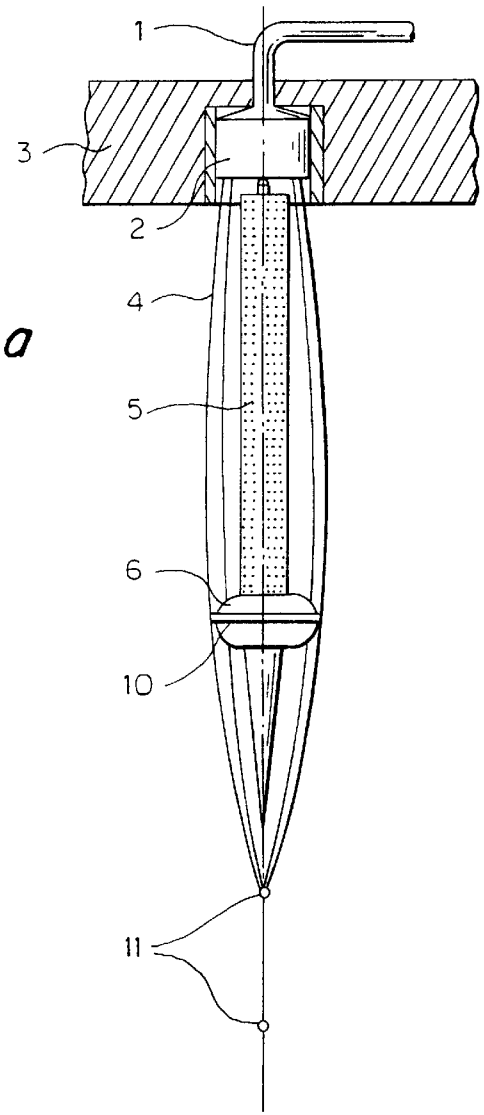

As a further embodiment for combining the filaments and the application of the preparation in accordance with FIG. 4, one or several height-adjustable preparation applicators 11 are provided, which are arranged one behind the other in the direction of filament travel and are supplied with a uniform amount of spinning preparation by means of a pump.

In other embodiments, in which the preparation is sprayed on, the arrangement of the spray spinnerets in the center for operating from the inside out, as well as on the outside for spraying toward the interior, is advantageous.

In a special embodiment of the device in accordance with the invention, a filament monitor is provided for each filament bundle, which registers a filament break and automatically and immediately releases a lock, so that the cooling unit is moved out of the filament path, preferably by its own weight, and the soiling or damage of the air flow candle is dependably prevented.

The invention also contains a method for producing microfilament yarns from thermoplastic polymers of maximally 500 dtex and with individual filament titers of maximally 1 dtex with great titer uniformity by means of the device in accordance with the invention and containing the steps of:

Melt spinning of the filaments with a total titer between 22 and 500 dtex at a spinning speed between 2000 and 7000 m/min, Uniform and position-stabilizing cooling of the filaments with tempered air by means of a cooling unit, Selective division of the filaments in separate guide elements into one or several filament bundles, Applying a preparation to the filament bundles, Winding of the separate filament bundles at a speed between 2000 and 7000 m/min, wherein the distance S is set as a function of the equation $$S = \frac{1.4 \times \exp(2.01 \times TEK)}{\sqrt[4]{RL}} - 1\,[\mathrm{mm}]$$

S=Distance between spinneret and cooling unit in [mm]

TEK=Titer of individual capillaries in dtex

RL=Number of rows of holes located behind each other on the spinneret to maximally 35 mm, and wherein in comparison with the melt temperature, the surface of the spinneret can experience homogeneous cooling up to 10° C. over the entire spinneret, and wherein the solidification point of the bundles of filaments is set as a function of the titer and spinning speed to 1 to 40 mm above the end of the effective cooling length Lk of the cooling unit.

The preferred individual filament titers in this method lie between 0.1 and 1 dtex, particularly preferred between 0.3 and 0.8 dtex, and the preferred total titer of the yarn at maximally 250 dtex.

Cooling of the spun filaments by the exactly centered cooling unit starts at a distance S below the spinneret, which maximally is 35 mm and preferably 5 mm to 10 mm. In this case it is particularly advantageous if this distance S is insulated in respect to the surroundings. This distance S is heated or cooled in preferred variations of the method.

If the spinnerets do not terminate flush with the spin-beam, i.e. if the nozzle is sunk into the spin-beam by the value R, the device in accordance with FIG. 1 is inserted recessed by the required distance S.

For adaptation to various filament titers, the distance S of the cooling unit from the spinneret 2 is set in the range between 0,2 mm to 35 mm, preferably in a range between 1 mm to 10 mm, wherein the following correlation applies:

$$S = \frac{1.4 \times \exp(2.01 \times TEK)}{\sqrt[4]{RL}} - 1\,[\mathrm{mm}]$$

S=Distance of the spinneret in [mm]

TEK=Titer of individual capillaries in dtex

RL=Number of rows of holes located behind each other on the spinneret.

Method variations with a heated space are particularly advantageous if deposits of monomers or oligomers are precipitated in the area of the spinneret during spinning of the polymers.

A heater which reduces interfering collections of deposits at the tip of the cooling unit increases the dependability of spinning in an advantageous manner.

The advantageous speeds of the blown-in air, measured at a distance of the innermost hole circle diameter of the capillary bores from the center of the cooling unit, lie between 0.05 and 0.7 m/s, preferably between 0.1 and 0.5 m/s, and are matched to the titer and spinning speed of the filaments. In this connection a suitable speed profile of the blown-in air along the cooling unit 5 is particularly important.

In an advantageous manner it is controlled by the use of displacement bodies in the interior of the cooling unit, wherein it is necessary to prevent the formation of turbulences.

In another variation the type and distribution of the perforations in particular are varied over the effective cooling length of the cooling unit as a function of the titer.

The effective cooling length Lk of the blowing path is at least 50 mm, maximally 1000 mm, and preferably lies between 100 mm and 500 mm.

The blown-in air is advantageously employed tempered to between 15 and 200° C., in preferred method variations between room temperature and 45° C. In further variations it is tempered to maximally 30 to maximally 10° C. below the $T_G$ of the spun polymer.

In another variation of the method the blown-in air is tempered only for the upper exit area of the so-called air flow candle, preferably for the upper ⅓ to ⅔ of the effective cooling length Lk.

The diameter of the cooling unit 5 of the device in accordance with the invention is essentially a function of the nozzle geometry. Customary diameters of the used for microfilament yarns spinnerets lie in a range between 70 mm to 110 mm.

Particularly advantageous for the distance of the cooling unit 5 from the innermost circle of the capillary bores in the spinneret 2, a radius difference of minimally 1 mm to maximally 40 mm, but preferably minimally 2 mm to maximally 30 mm, is set. Thus, a preferred range of minimally 10 mm to maximally 106 mm results for the diameter of the cooling unit of the device in accordance with the invention. Diameters up to maximally approximately 60 mm are particularly preferred.

Figure 8:
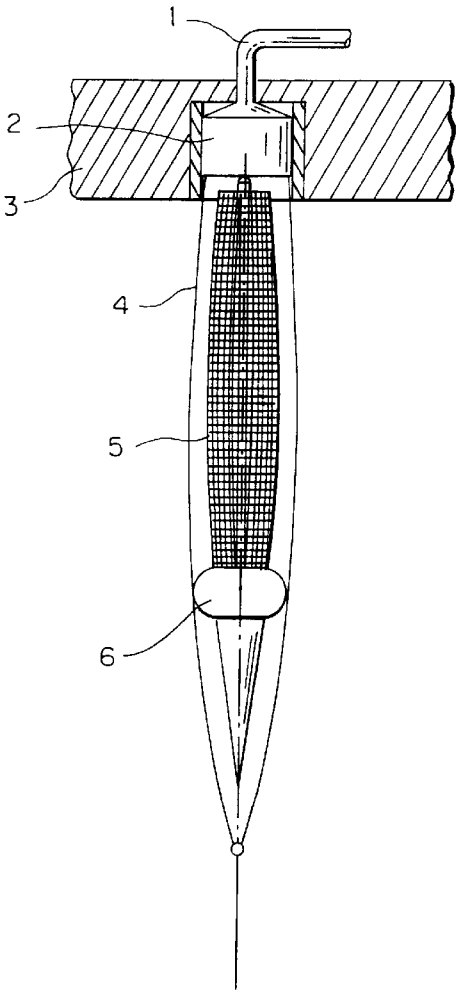
FIG. 8 shows a hose in the form of a double cone as a cooling unit.

A further special method variant employs a cooling unit consisting of a hose-shaped, heat-resistant and air-permeable woven material, which is inflated by a gas overpressure in its interior and can be matched, shaped in a double cone, to the path of the filaments (FIG. 8). An excellent uniformity of the filaments over the distance of the effective cooling length Lk is achieved by the particularly short distance from the filament bundle. The effective cooling length Lk is determined by the largest titer of the method. It is important that the solidification point of the cooled filament bundle lies before the first contact with the device.

This point is advantageously fixed at least 1 mm, but preferably at least 40 mm before the end of the length Lk. The manufacture of different products and an optimization of the yarn tension is set in the method in accordance with the invention by means of changing the length Lk.

The adaptation of the cooling unit to the various nozzle geometries, titer and filament numbers, and therefore to the changing aerodynamics over the length Lk, is performed in this way. In this case the use of a bellows embodiment (FIG. 9*a*), which can be continuously adjusted in length, and a pluggable embodiment (FIG. 9*b*) have been shown to be particularly suitable. The advantageous length lies between 50 mm and 1000 mm, but preferably in the range between 100 mm to 500 mm.

It can also be advantageously adapted by inserted unperforated or differently perforated pieces. This is a particularly simple way of adapting the device to various melt throughputs and therefore different products, but also for regulating the yarn tension required for winding the filament yarns.

For maintenance work on the spinneret, which is required at fixed time intervals, the central cooling unit must be temporarily removed from the work area of the spinneret. This takes place in the simplest way by pivoting the cooling unit out around a pivot point in the direction of the rear of the machine.

Figure 11:
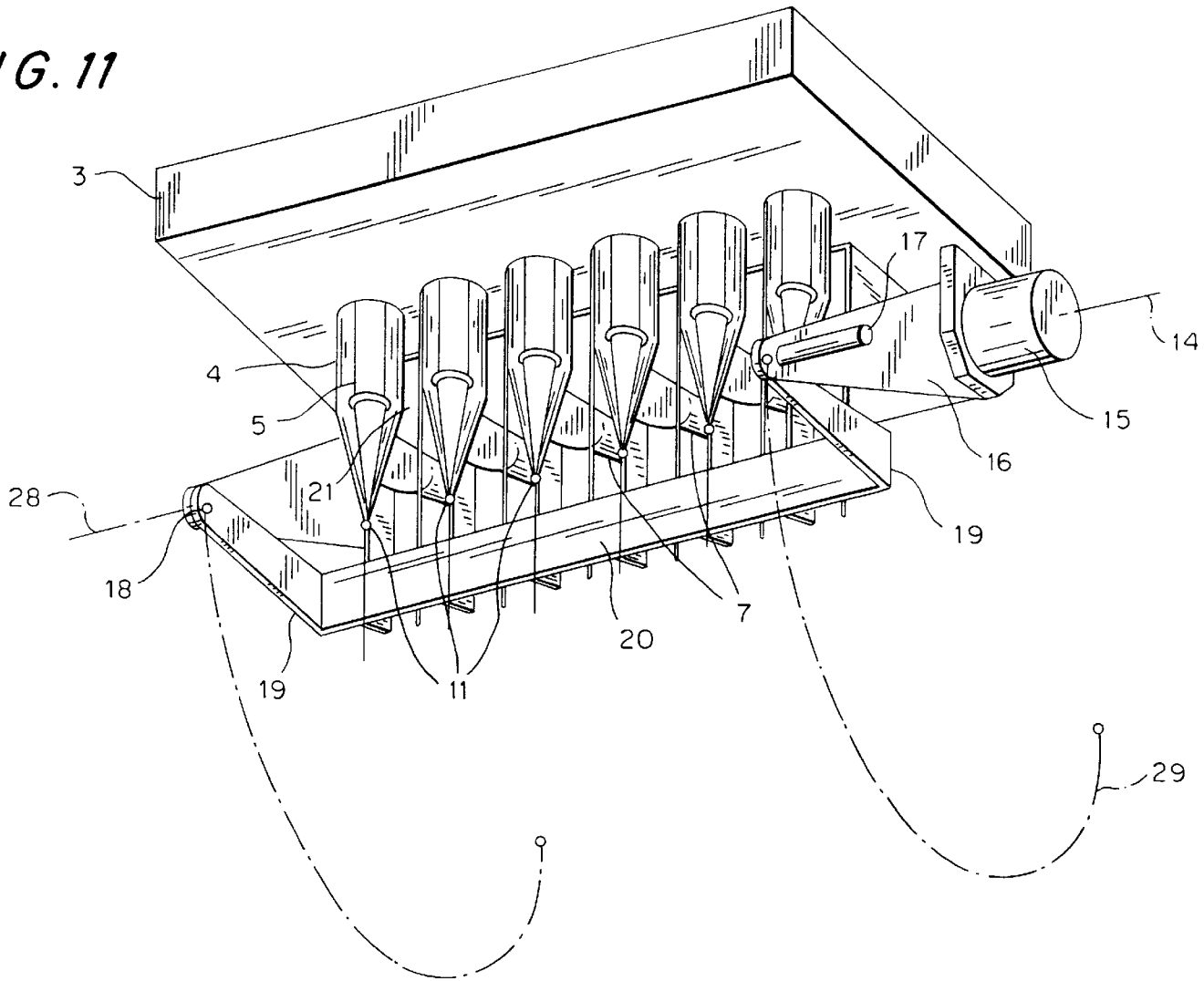
Figure 12:
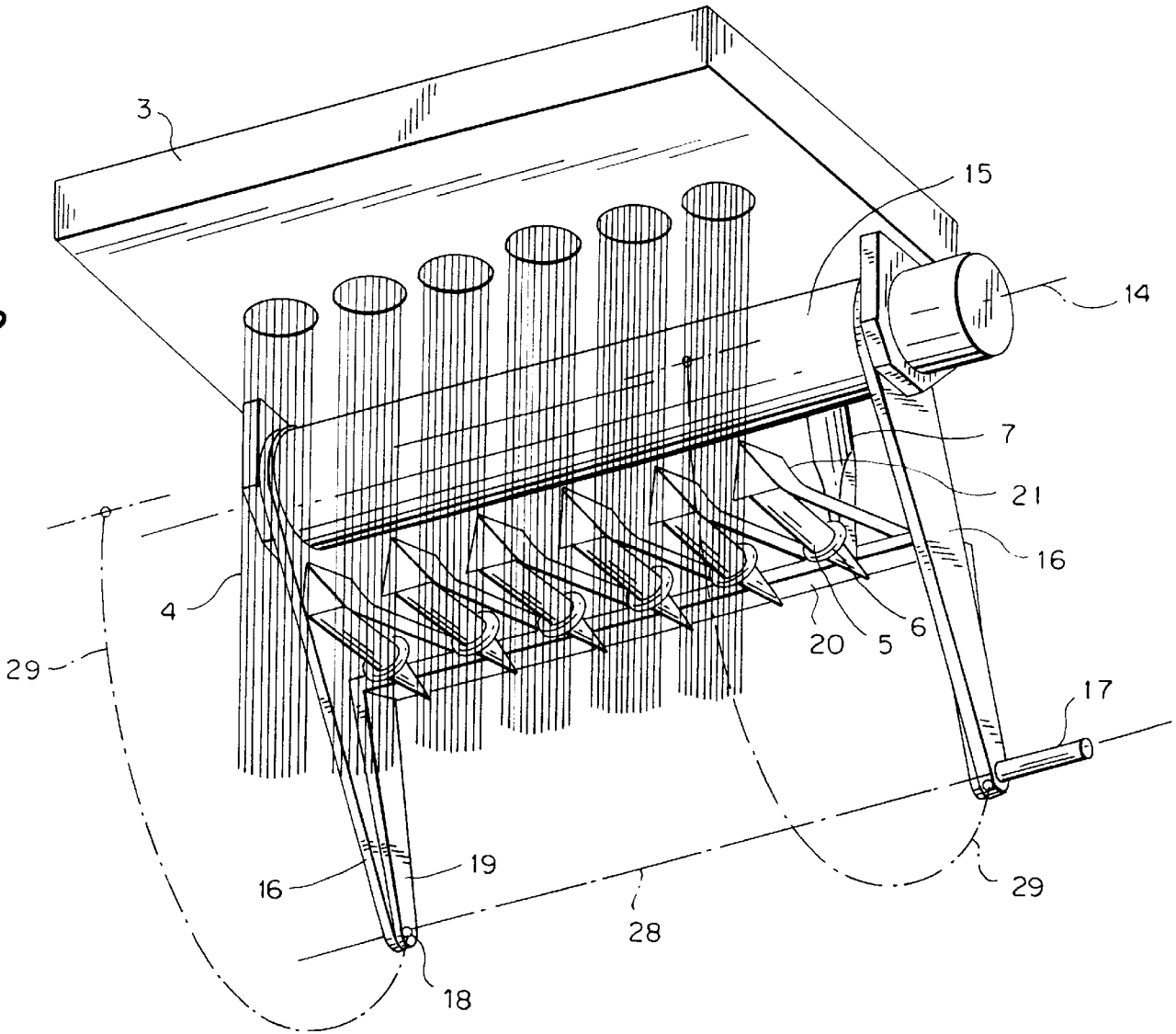
FIG. 12 represents a spinning installation with cooling units pivoted out (maintenance position)
Figure 13:
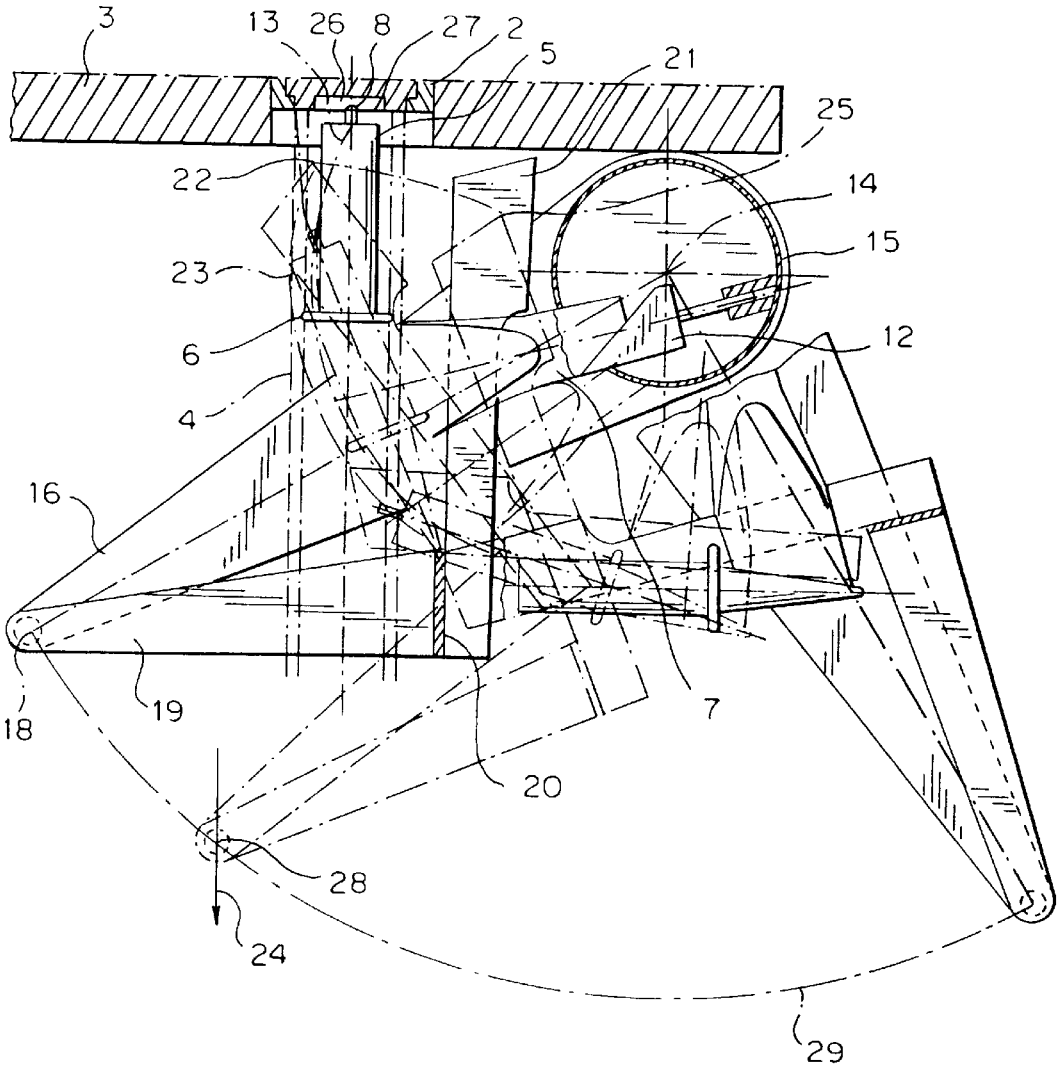
FIG. 13 is a lateral view of the cooling unit with schematically represented movement phases.

A multiple arrangement of a preferred embodiment of the invention is schematically represented in FIGS. 11, 12 and 13. It consists of at least one cooling unit 5, which can be completely pivoted out of the area of the running filaments 4. In its inserted operating position it engages, with a centering pin arranged at its tip, a centered bore cut into the spinneret 2 (FIG. 13).

The maintenance position with the pivoted-out cooling units is represented in FIG. 12. FIG. 13 shows a lateral view of the device, in which the individual movement phases can be followed.

The arrangement is distinguished by a circular pivot path 13, whose axis 14 extends inside the cross section of an air supply conduit 15, which is rotatable along with the pivot movement, wherein at least one, but preferably any arbitrary number, particularly preferred two to twelve cooling units 5, can be pivoted by means of a common mechanical insertion and removal device into a corresponding number of bundles of filaments 4. For this purpose they are fastened together on the air supply conduit 15 via respectively one connector or insertion device 7, which conducts blown-in air from the air supply conduit 15 to the cooling unit 5. The device is designed to be flat, at least in the area of the filament path in the vicinity of the positioning yarn guide 6, and preferably has a narrow rectangular cross section. On the exterior, the pivot movement is respectively transmitted by a lever 16, which in turn is actuated by means of a drive, not represented, or in a preferred embodiment manually via a handle 17, and in the process travels along the arc 29. A second lever 19 is respectively arranged on respective bearing points 18 of the levers 16, and respectively supports one plow-like filament divider 21 per cooling unit 5 on a cross bar 20 connected to it. Thus, all filament dividers 21 can be pivoted together around the pivot axis 28 extending through the bearing points 18 and are held in the pivoted-out position of the cooling units 5 by their own weight in an end point 22 which, in FIG. 13, lies at the left end of their common pivot path around the pivot axis 28 of the filament divider 21 and marks the active position. In the course of the pivoting-in movement of the cooling units 5, it pivots along on its arc 23 around the axis 14 and dips into the filament bundle 4 in front of the cooling unit 5, divides the bundle, and laterally deflects the individual filaments, so that they do not get on the cooling unit 5 being pivoted in until, by the mutual rotation around the axis 14, the gravity vector 24, which acts on the center of gravity of the system consisting of the lever 19, the cross bar 20 and the filament divider 21, has intersected the pivot axis 28 extending through the bearing points 18, so that the device is tilted around the bearing points 25 into its opposite end position 25, and therefore into its passive, or maintenance position. Because of this, the filament dividers 21 pivot out of the filament bundle 4 and release it on the last portion of the insertion path 13 of the cooling unit 5, so that the centering pins can move into the centered bores in the spinning tie plates 2 which are assigned to them. Simultaneously the entire path of the filament bundles 4 is released for the spinning process and the described operation during the pivoting of the cooling units 5 out of the path of the filament bundles is repeated in the opposite sequence.

As soon as a spinning malfunction occurs (response of a yarn break monitor), the cooling unit 5 pivots automatically, because of its weight, or because of a spring which was tensed when it pivoted in, or by a drive provided with outside energy, out of the area of the running filaments into a maintenance position in accordance with FIG. 12. The mechanical devices and gear arrangements required for this are not part of the present invention and are therefore not represented for reasons of clarity.

Furthermore, to prevent a too large heat flow from being diverted from the spinneret 2 via the centering pin during the spinning process, spinnerets 2 are employed, whose central area has advantageously been provided with heat insulation, which preferably takes place by means of a recess 28, which is filled with a heat-insulating material or, in another embodiment, is evacuated, heated if required, and closed off by a cover 27 which is preferably welded in.

The air supply can be adjusted by means of an arrestable throttle device 12 for each one of the individual insertion devices 7 or connectors.

Following cooling and solidification, the filaments are bundled and thereafter are provided with a preparation by contact or spraying, wherein the yarn guides and/or the preparation unit are positioned at least 1 to 40 mm ahead of the end of the effective cooling length Lk.

The filaments, which are arranged concentrically around the cooling unit, could inadvertently touch the insertion device in its area in the unprepared state, which has the result that they have properties which are changed in relation to the remaining filaments, which is not desired.

This touching is prevented in the simplest case by employing a spinneret which does not have capillary bores in the area of the insertion device, i.e. the concentric circles of nozzle holes are therefore interrupted at this location. If, for reasons of a polymer distribution which is as homogeneous as possible, the circle of the capillary bores is not to be interrupted, a special embodiment in accordance with the invention of the cooling unit provides an arrangement of a yarn guide below the air supply in accordance with FIG. 3, which has a drop-like shape in the area of the filament contact with the insertion device, because of which contact only occurs at this yarn guide and is nearly identical for all filaments of a bundle.

A further method variation lies in the generation of an air cushion from the air accompanying the filaments by means of friction-reducing structures or stampings in the form of scales, (FIG. 2*b*), diamonds, diagonal lines, etc. on the surface of the arm of the insertion device in the area of the filament contact, because of which a direct contact between filaments and the arm of the insertion device is prevented to the greatest extent.

A further method variation lies in the prevention of a dry contact between filaments and the insertion device. FIG. 2 be shows by way of example how this device is provided with fine openings in the area of the passing filaments, which permit the creation of an air cushion by means of the exiting air, which prevents the contact of the filaments with the device.

Here, the outlet opening for the air is designed in such a way that it flows uniformly radially. In a special embodiment it has been provided that the air is aimed in the direction of the running direction of the filaments.

A further method variation is the application of the spinning preparation in accordance with FIG. 4 after the filaments have been bundled by means of one or several preparation applicators 11, which are arranged one behind the other in the filament running direction and are provided with a homogeneous amount of a spinning preparation by means of a pump.

In preferred other embodiments, the preparation can be sprayed on in a direction from the inside to the outside, as well as from the outside to the inside. In a further method variation, air stripping panels, which are arranged near the front of the preparation applicator in the filament run, assure the undisturbed and therefore uniform application of the preparation. In order to avoid undesired oscillating self-movement of the filaments on the cooling path, the additional arrangement of a ring-shaped positioning yarn guide 6, designed dry or as a preparation application element with a sufficiently large diameter, is advantageous (FIG. 4).

In accordance with FIG. 5*a,* in a further method a gas flow is conducted through the ring-shaped gap in a positioning yarn guide, because of which the individual filaments run on a gas cushion on the entire ring circumference, and the friction between the positioning yarn guide and the filaments is reduced. In an additional variation, a positioning yarn guide made of a cone which widens downward in a trumpet shape in accordance with FIG. 5 is used. The air carried along by the filaments is deflected on this cone and directed against the filaments. An air cushion is formed by this diverted dragged air, so that the direct friction between the filaments and the filament guide is avoided.

In method variations with the employment of a cooling unit 5, which has been designed to come to a point toward the bottom in a cone shape, it is possible to achieve extremely short lengths up to the bundling of the filaments 4, so that it is possible to omit a positioning yarn guide.

Figure 6A:
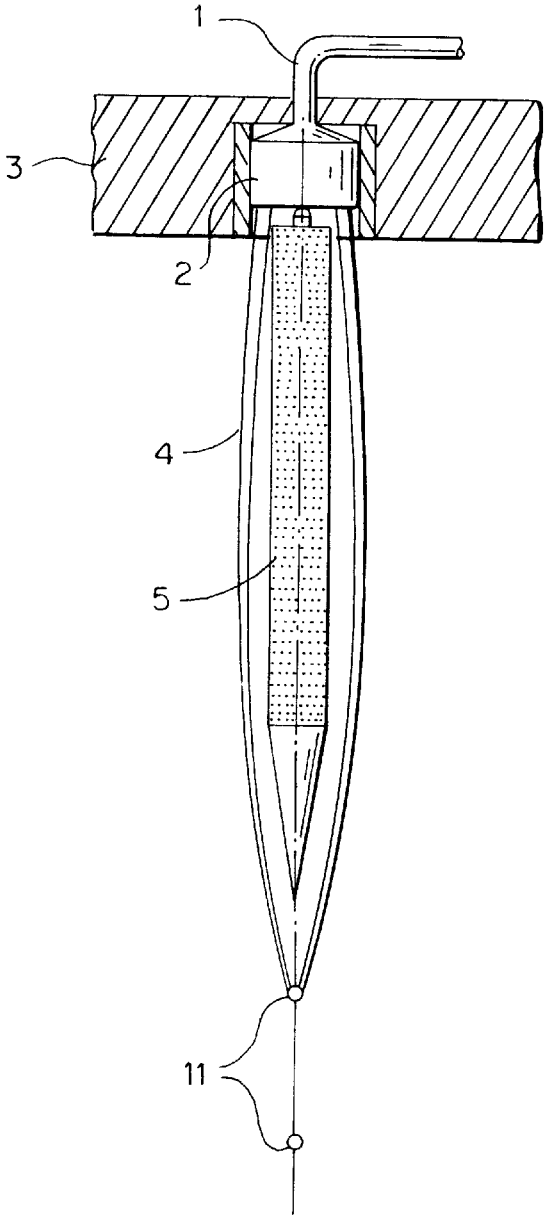
Figure 6B:
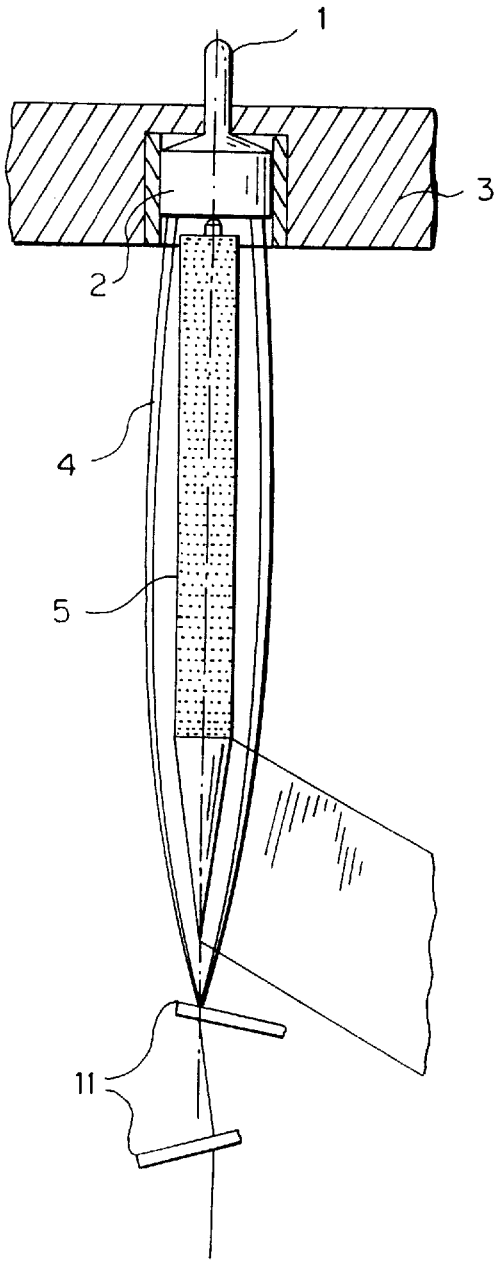

In a particularly suitable embodiment of the method, the filaments are conducted directly to the preparation applicators 11 without prior contact, as represented in FIG. 6.

Figure 7:
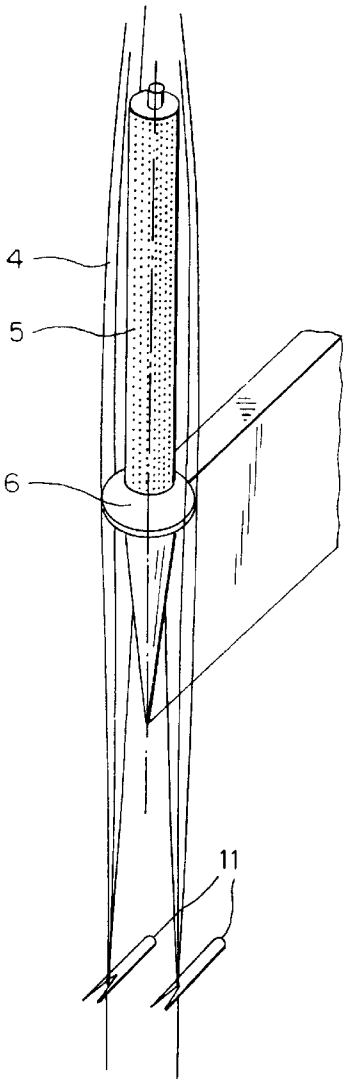
FIG. 7 represents a method with two separate filament bundles.

For spinning several filament bundles in a spinneret 2, the filament sheet is divided in accordance with FIG. 7, and the filament bundles being created are separately gathered, treated and wound.

It is possible by means of this method to clearly reduce the equipment costs, and therefore the production costs, without a reduction in quality.

In order to prevent piling up of the no longer removed filaments on the cooling unit or on a yarn guide element in case of a filament break, the method in accordance with the invention provides a yarn monitor for each filament bundle. If this yarn monitor reports a break, a lock (not represented) is automatically and immediately released, whereupon the cooling unit is removed from the filament path by its own weight or a spring force, is moved into a so-called maintenance position, and damage or soiling of the air flow candle, or even the spinneret, is dependably prevented by this.

Because of the more uniform and position-stabilizing blowing on the filaments by means of the central cooling unit 5, the hole density of the spinnerets 2 can be increased in the present method to as many as 40 holes/cm$^2$, but preferably to as many as 35 holes/cm5, in comparison with 8 holes/cm$^2$ for a cross-flow diffusion and 25 holes/cm$^2$ for a device in accordance with patent document EP 0 646 189 B1.

The uniformity of the individual filaments and therefore of the filament yarn is improved at the same time. Analogously with patent document EP 0 646 189 B1, the surface which is decisive for the extrusion is taken into consideration for calculating the hole density.

Because of the increased uniformity of the microfilaments produced in accordance with the method of the invention, it is possible

- to increase production speed,
- to minimize production downtimes,
- to reduce the space requirements of the spinning machine,
- to reduce the diameter of the spinnerets because of the increased hole density, or
- with an unchanged diameter of the spinnerets, to spin several separate filament bundles per spinneret, to further process them separately and to wind them, or respectively
- for creating a fixed number of filaments per machine, to clearly reduce the number of spinnerets and/or the length of the spinning installation, i.e the spin-beam, and therefore
- to considerably lower the investment costs for the installation and therefore also the product costs.

The principle of the method in accordance with the invention is represented in FIG. 1:

The polymer melt is supplied via the melt line 1 to the spinneret 2 in the spin-beam 3. The melt then exits the capillary bores of the spinneret 2 in the form of filaments. For solidification, they are conducted concentrically along the cooling unit 5 of the device in accordance with the invention, are gathered and subsequently wound in the winding unit 8.

Below the so-called air flow candle or cooling unit 5, a positioning yarn guide 6 of a ring-shaped geometric arrangement takes over the fixation of the filaments 4. It can simultaneously also be used for preparing the filaments 4.

Example 1 (central cooling device) shows how the quality is clearly improved in comparison with the comparison example 2 (cross-flow diffusion) in respect to uniformity (Uster values and Uster ½ values) and the quality (grade number). The values shown in example 3 confirm that, using the device in accordance with the invention, the quality of a yarn which consists of very many microfilaments is clearly better than the one shown in comparison example 5, which uses a device in accordance with the prior art. Example 4 makes it clear that, using the method in accordance with the invention with the device in accordance with the invention, it is possible to increase the hole number and to achieve a considerably improved quality over a device in accordance with the prior art. The manufacture of such high-capillary products while using the same nozzle diameter was not possible with the aid of cross-flow diffusion. This improved quality of the method in accordance with the invention with the device in accordance with the invention can be utilized for increasing the speed of the method in comparison with systems of the prior art. The hole number related in examples 3 and 5 is also suitable for spinning two individual bundles of 120 filaments each with this spinneret. The spinneret of example 2 would be suitable for spinning three individual bundles of 120 filaments each.

Contrary to expectations, microfilament yarns have not been accepted to the expected degree in spite of their advantages for the consumer. Important reasons for this are the difficult handling of a uniform dye absorption of such yarns in comparison with yarns in the normal filament titer range, and the inevitably reduced production speed of the further processing steps.

A yarn with individual filaments of high titer uniformity is now provided by means of the method in accordance with the invention. Said microfilament yarn is distinguished by its improved physical textile properties, in particular an outstandingly uniform dye absorption, and which can be manufactured at high production speeds.

As is known to one skilled in the art, the Uster non-uniformity is an essential parameter for judging the quality of a filament yarn in regard to the uniformity of the filament titer to be expected, the physical textile properties and the dye absorption of this yarn in the finished fabric. The higher the measured Uster value, the worse the dye uniformity will be later, for example. Particularly interfering are color affinities which are varied in long waves, since they appear considerably more clearly in the finished fabric than faults of short period. Such dye errors can lead to serious processing problems and expensive complaints. The Uster value U½, expressed in percent, can be made the basis for the parameter for problem-free further dye processing. In connection with yarns in the normal filament titer range, values for U of 0.40% to 0.70%, and for U½ of 0.25% to 0.65% are usually achieved here. As a rule, no dye problems are found in connection with such yarns.

With microfilament yarns spun in accordance with the prior art, increased values of 0.70 to 0.95 are customary. By using the method in accordance with the invention it is possible to produce filament yarns in a range safe for dying of 0.25% to 0.70% for U½. An additional advantage of the method in accordance with the invention lies in the increase of the cleaning cycle frequency of the nozzle surface because of the surface temperatures of the spinneret, which are up to 45% lower.

In accordance with the prior art it is known that it is necessary to employ higher spinning temperatures for improving the spinning performance for producing filaments from polymers with a filament titer under 1 dtex/filament. However, the increased temperatures have the disadvantage that the thermal decomposition of the polymer melt in the spin-beam and the nozzle package is accelerated.

Surprisingly it has been found that it is possible by means of the method in accordance with the invention when using the device in accordance with the invention to lower the surface temperature homogeneously over the entire spinneret by up to 5° C., preferably even up to 10° C. The lower temperature of the spinneret has the result that the thermal decomposition rate of the polymer melt exiting the capillary bores is lowered at the surface and that the intervals for nozzle cleaning are increased by this.

The increased yarn tension, which also occurs because of this, stabilizes the filaments and results in increased uniformity, or respectively a very low Uster value.

It was also surprisingly found that the physical textile yarn properties are improved by the demployment of the device in accordance with the invention in the method in accordance with the invention. For example, the so-called grade number in particular rises also with a constant production speed, and the CV expansion and CV strength are improved (Example 1). The method in accordance with the invention is excellently suitable for textile microfilaments which are to be further processed in a special way. It is possible for this purpose to additionally interlace the filament bundle prior to winding and, if required, to apply preparation for a further time.

It is also practical if prior to winding the filament bundle is to be heated by means of galettes or cooled and simultaneously or subsequently stretched, shrunk, crimped and/or interlaced.

The reduction of filament and yarn breaks, as shown in the examples, makes the method particularly suitable for spinning at high spinning speeds, such as are used for producing highly oriented filament yarn.

Moreover, the intense cooling of the device makes possible a reduction of the convergence length, because of which reduced spinning yarn tension become possible. By means of this, problem- free, galette-free working at high draw-off speeds becomes practical in comparison with conventional methods.

The method is advantageously used for spinning microfilament yarns from thermoplastic polymers, wherein those made from polyamide, polyester or polyolefins are preferred.

The invention also includes the microfilament yarns produced in accordance with the disclosed method, which preferably have individual titers of 0.2 to 1.0 dtex, and in particular those, which show Uster values below 0.9% at grade numbers of 29 to 35/% * N/dtex (grade number= strength * /elongation).

It also includes those microfilament yarns which are intended to be further processed into highly-oriented filament yarns in an additional method step by being stretched, shrunk, crimped and/or interlaced, or at especially high process speeds.

Advantageously this process step is integrated into the method in accordance with the invention prior to winding.

| | Examples: | | | | |
|---|---|---|---|---|---|
| Example | Device in acc. w/the invention 1 | Standard/Cross-Flow 2 | Device in acc. w/the invention 3 | Device in acc. w/ the invention 4 | Standard Cross-flow 5 |
| Polymer | PET | PET | PET | PET | PET |
| Rel. viscosity [1% m-cresol, 25° C.] | 1.64 | 1.64 | 1.64 | 1.64 | 1.64 |
| Melt temperature [° C.] | 290 | 296 | 290 | 290 | 296 |
| Spinneret diameter [mm] | 70 | 70 | 70 | 70 | 95 |
| Number of holes | 144 | 144 | 288 | 360 | 288 |
| Interior diameter [mm] | 40 | 0 | 40 | 43 | 0 |
| Exterior diameter [mm] | 56 | 56 | 56 | 56 | 73 |
| Hole density [number/cm$^2$] | 11.9 | 5.8 | 23.9 | 35.6 | 6.9 |
| Throughput [g/min] | 36.1 | 36.4 | 53.0 | 43.2 | 54.0 |
| Length of "candle" [mm] | 350 | — | 300 | 280 | — |
| Diameter of "candle" [mm] | 34 | — | 22 | 24 | — |
| Distance S [mm] | 3 | 20 | 2 | 1 | 20 |
| Diffusion length [mm] | 350 | 600 | 300 | 280 | 600 |
| Blown air velocity [m/s] | 0.35 | 0.35 | 0.38 | 0.38 | 0.3 |

-continued

| Example | Examples: Device in acc. w/the invention 1 | Standard/Cross-Flow 2 | Device in acc. w/the invention 3 | Device in acc. w/ the invention 4 | Standard Cross-flow 5 |
|---|---|---|---|---|---|
| Blown air temperature [° C.] | 21 | 21 | 21 | 21 | 21 |
| Convergence length [mm] | 560 | 600 | 550 | 550 | 590 |
| Spinning speed [m/min] | 2900 | 2900 | 2400 | 2215 | 2400 |
| Total titer [dtex] | 124.9 | 125.9 | 221.4 | 195.4 | 225.6 |
| Capillary titer [dtex] | 0.87 | 0.87 | 0.77 | 0.54 | 0.78 |
| Elongation at tear [%] | 109.2 | 111.1 | 105.0 | 100.4 | 109.9 |
| CV elongation at tear [%] | 2.4 | 2.9 | 3.1 | 3.3 | 7.2 |
| Tear resistance [cN/dtex] | 2.75 | 2.58 | 2.68 | 2.70 | 2.48 |
| CV tear resistance [%] | 2.3 | 3.1 | 3.2 | 3.6 | 6.1 |
| Uster [%] | 0.62 | 0.83 | 0.82 | 1.14 | 1.64 |
| Uster ½ [%] | 0.31 | 0.71 | 0.62 | 0.68 | 1.41 |
| Dye absorption - gray scale | 5 | 4–5 | 5 | 5 | 4 |
| Grade number | 28.7 | 27.2 | 27.5 | 27.1 | 26.0 |
| Filament breaks [number/t] | 0.3 | 2.2 | 0.3 | 1 | 5.7 |
| Fluff [number/10,000 m] | 0.4 | 2.3 | 1.1 | 1.3 | 4.0 |

What is claimed is:

1. A device for producing microfilament yarns from thermoplastic polymers with a maximum of 500 dtex total titer and with individual filament titers of a maximum 1 dtex and high titer uniformity, comprising a spinneret with capillary holes in a ring-shaped arrangement and a hole density L/A of up to 40 holes/cm$^2$ of effective outlet surface, an air-permeable active cooling unit for tempered air, which is centrally located at the distance S under the spinneret and fixed in place, an insertion device with integrated air supply devices for the cooling unit, at least one yarn guide element selected from the group consisting of yarn guides of guide panels, at least one preparation application device, a yarn monitor, which is optionally combined with a control of the insertion device, and at least one winding unit, wherein the filaments spun together out of the spinneret are conducted, individually or divided into more than one separate filament bundle, provided with preparation and wound, wherein the distance S is set as a function of the equation $$S = \frac{1.4 \times \exp(2.01 \times TEK)}{\sqrt[4]{RL}} - 1\,[\text{mm}];$$

wherein

S=Distance between the spinneret and cooling unit in [mm]

TEK=Titer of individual capillaries in dtex

RL=Number of rows of holes located behind each other on the spinneret to maximally 35 mm, and wherein the effective cooling length Lk of the cooling unit is set as a function of the titer and the spinning speed.

2. The device in accordance with claim 1, wherein the ring-shaped arrangement of the holes in the spinneret is interrupted or divided into groups.

3. The device in accordance with claim 1, wherein filament guide elements divide the filaments from a spinneret into at least two separate filament bundles.

4. The device in accordance with claim 1, wherein the distance S between the spinneret and the cooling unit is provided with insulation.

5. The device in accordance with claim 1, wherein the insulation is provided with heating or with cooling elements.

6. The device in accordance with claim 1, wherein the distance S is 0.2 mm to 35 mm.

7. The device in accordance with claim 1, wherein the distance S is 1 mm to 10 mm.

8. The device in accordance with claim 1, wherein the active cooling unit consists of an air-permeable woven material.

9. The device in accordance with claim 1, wherein the active cooling unit consists of at least one perforated tube element, closed on one end.

10. The device in accordance with claim 1, wherein the cooling unit consists of an upward and a downward-directed tube element.

11. The device in accordance with claim 1, wherein the cooling unit is positioned horizontally and vertically or on a circular pivot path by means of the insertion device, and is fixed in place centered in respect to the spinneret by means of a centering pin.

12. The device in accordance with claim 1, wherein means are Provided for automatically moving the cooling unit out of the filament path into a maintenance position in case of malfunctions.

13. The device in accordance with claim 1, wherein the insertion device is provided with mechanical, pneumatic, or electronic controls.

14. The device in accordance with claim 1, wherein the shape of the surface or perforations on the insertion device is designed to repel filaments.

15. The device in accordance with claim 1, wherein the insertion device turns on a circular insertion path around an axis, wherein the pivot movement is transmitted via a lever, on which a second level is hinged by means of a bearing point, wherein this second lever supports a filament divider in the form of a plow-share by means of a cross bar, so that this filament divider is pivoted on the one hand around the bearing point and on the other hand together with the cooling unit around the axis, so that in the course of pivoting the cooling unit into the filament path it is initially covered by the filament divider so that the filament divider is first immersed into the filament path and divides it, so that the cooling unit is not touched by the filaments until the vertical movement of the cooling unit has been completed and the cooling unit is completely located underneath the central area of the spinneret which is not perforated by capillary bores, whereafter the filament divider is pivoted around the bearing point out of the filament path and unblocks the path of the filaments.

16. The device in accordance with claim 1, wherein the length and diameter of the cooling unit are variable, wherein the diameter lies in the range between 10 mm and 106 mm and is at least less by 1 mm than the interior diameter of the smallest circle of the capillary bores arranged in a ring shape.

17. The device in accordance with claim 1, wherein the effective cooling length Lk and the embodiment of the perforations of the cooling unit are adapted in titer and spinning speed to the filaments to be cooled.

18. The device in accordance with claim 1, wherein the air is tempered between 15° C. to 200° C.

19. The device in accordance with claim 1, wherein exit speed and/or the exit temperature and/or the exit direction of the air over the length Lk of the cooling unit is variably set, adapted to the titer and the spinning speed of the filaments.

20. The device in accordance with claim 1, wherein the filament guide and the preparation application device are height-adjustable, so that the solidification point of the filaments can also be set at least 1 to 40 mm ahead of the effective end of the cooling unit (5).

21. The device in accordance with claim 1, wherein the filament guide is designed as a support ring or a funnel with or without additional air output.

22. The device in accordance with claim 1, wherein the filament guide is designed to be drop-shaped.

23. A method for producing microfilament yarns from thermoplastic polymers of maximally 500 dtex total titer and with individual titers of filaments of maximally 1 dtex and with great titer uniformity by means of the device in accordance with claim 1, comprising:

melt spinning of the filaments with a total titer between 22 and 500 dtex at a spinning speed between 2000 and 7000 m/min, cooling the filaments with tempered air by means of a cooling unit with an effective cooling length Lk at the distance S from the spinneret, division of the filaments in separate guide elements into one or several filament bundles, applying a preparation to the filament bundles, winding the separate filament bundles at a speed between 2000 and 7000 m/min, wherein the distance S is set as a function of the equation wherein $$S = \frac{1.4 \times \exp(2.01 \times TEK)}{\sqrt[4]{RL}} - 1[\text{mm}]$$

S=Distance between spinneret and cooling unit in [mm]

TEK=Titer of individual capillaries in dtex

RL=Number of rows of holes located behind each other on the spinneret to maximally 35 mm, and wherein in comparison with the melt temperature, the surface of the spinneret can experience homogeneous cooling up to 10° C. over the entire spinneret, and wherein the solidification point of the bundles of filaments is set as a function of the titer and spinning speed to 1 to 40 mm above the end of the effective cooling length Lk of the cooling unit.

24. The method in accordance with claim 23, wherein the individual titer of the filaments lies between 0.2 and 1 dtex.

25. The method in accordance with claim 23, wherein the distance S is insulated, cooled or heated.

26. The method in accordance with claim 23, wherein the distance S is set between 1 mm and 35 mm.

27. The method in accordance with claim 23, wherein the distance S is set between 1 mm and 10 mm.

28. The method in accordance with claim 23, wherein an air speed, adapted to the titer and the spinning speed of the filaments, is set, variably between 0.05 and 0.7 m/s, over the effective cooling length Lk of the cooling unit.

29. The method in accordance with claim 23, wherein tempered air at a temperature between 15 and 200° C. is used in the cooling unit.

30. The method in accordance with claim 23, wherein tempered air of 10° C. to 30° C. below the $T_G$ of the polymer is used.

31. The method in accordance with claim 23, wherein differently tempered and/or directed air is used in different areas of the cooling unit.

32. The method in accordance with claim 23, wherein the solidification point of the filament bundles is set as a function of the titer and the spinning speed at 1 to 40 mm above the effective end of the cooling unit.

33. The method in accordance with claim 23, wherein the preparation is applied through a ring gap or by spraying it on.

34. The method in accordance with claim 23, wherein polyamides, polyesters or polyolefines are used as synthetic polymers.

* * * * *